US009452813B2

(12) United States Patent
Saruwatari

(10) Patent No.: US 9,452,813 B2
(45) Date of Patent: Sep. 27, 2016

(54) OUTBOARD MOTOR AND OIL PAN UNIT FOR OUTBOARD MOTOR

(71) Applicant: YAMAHA HATSUDOKI KABUSHIKI KAISHA, Iwata-shi, Shizuoka (JP)

(72) Inventor: Kimitaka Saruwatari, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/658,305

(22) Filed: Mar. 16, 2015

(65) Prior Publication Data

US 2016/0001862 A1 Jan. 7, 2016

(30) Foreign Application Priority Data

Jul. 1, 2014 (JP) ..... 2014-135608

(51) Int. Cl.
*B63H 20/00* (2006.01)
*B63H 20/32* (2006.01)

(52) U.S. Cl.
CPC ..... *B63H 20/002* (2013.01); *B63H 20/32* (2013.01); *B63H 2020/323* (2013.01)

(58) Field of Classification Search
CPC ..... B63H 20/002; B63H 20/32
USPC ..... 440/88 L
See application file for complete search history.

(56) References Cited

U.S. PATENT DOCUMENTS

| | | | | |
|---|---|---|---|---|
| 5,997,372 | A * | 12/1999 | Idzikowski | B63H 20/002 123/196 A |
| 6,564,905 | B1 * | 5/2003 | Yukioka | F01M 1/02 123/192.2 |
| 6,913,498 | B1 * | 7/2005 | Sheth | B63H 23/32 440/88 C |
| 8,424,647 | B2 | 4/2013 | Miyazaki et al. | |

FOREIGN PATENT DOCUMENTS

| | | |
|---|---|---|
| JP | 05-052107 A | 3/1993 |
| JP | 2000-297620 A | 10/2000 |
| JP | 2006-177252 A | 7/2006 |
| JP | 2009-102993 A | 5/2009 |

* cited by examiner

*Primary Examiner* — Stephen Avila
(74) *Attorney, Agent, or Firm* — Keating and Bennett, LLP

(57) ABSTRACT

An outboard motor includes an engine including a plurality of cylinders, a drive shaft, an oil pan portion provided below the engine and including an oil storage region, an oil pump configured to be driven by a drive portion of the drive shaft passing through the oil storage region and located in the oil storage region, and a supply path configured to supply oil from the oil pump to the engine.

23 Claims, 6 Drawing Sheets

FIRST EMBODIMENT

SECOND EMBODIMENT

THIRD EMBODIMENT

OUTBOARD MOTOR AND OIL PAN UNIT FOR OUTBOARD MOTOR

CROSS-REFERENCE TO RELATED APPLICATION

This application claims priority to Patent Application No. 2014-135608, filed in Japan on Jul. 1, 2014, the entire contents of which are hereby incorporated by reference.

BACKGROUND OF THE INVENTION

1. Field of the Invention

The present invention relates to an outboard motor and an oil pan unit for an outboard motor, and more particularly, it relates to an outboard motor and an oil pan unit for an outboard motor each including an oil pump.

2. Description of the Related Art

An outboard motor including an oil pump is known in general. Such an outboard motor is disclosed in Japanese Patent Laying-Open No. 2009-102993, for example.

Japanese Patent Laying-Open No. 2009-102993 discloses an outboard motor including an engine including a plurality of cylinders and a crankshaft, a drive shaft coupled to the crankshaft and configured to transmit the rotational power of the crankshaft, an oil pan provided below the engine, an oil pump driven by the crankshaft, and a supply path configured to supply oil from the oil pump to the engine. In the outboard motor according to Japanese Patent Laying-Open No. 2009-102993, the oil pump is arranged above the oil pan and sucks up oil from the oil pan to supply the oil to the engine.

In the outboard motor according to Japanese Patent Laying-Open No. 2009-102993, the oil pump is provided above the oil pan, and hence a path to suck up the oil from the oil pan is required. When the length of this path is increased, a time from when the oil pump is driven until when oil is supplied to the engine (hydraulic pressure rise time) is increased. The path of oil is required to be configured such that priming oil for sucking up oil from the oil pan when the oil pump is started remains, and hence the structure of the path is complicated. Therefore, it has been desired to simplify the structure of the path of oil and to reduce the time from when the oil pump is driven until when oil is supplied to the engine (hydraulic pressure rise time).

In general, an outboard motor in which an oil pump is provided below an oil pan has also been disclosed. Such an outboard motor is disclosed in Japanese Patent Laying-Open No. 05-052107 (1993), for example.

Japanese Patent Laying-Open No. 05-052107 discloses an outboard motor including an oil pump arranged below an oil pan and configured to be driven by a drive shaft. In the outboard motor according to Japanese Patent Laying-Open No. 05-052107, the oil pump is spaced apart and below the oil pan through a pipe coupled to a lower end of the oil pan and a strainer.

In the outboard motor according to Japanese Patent Laying-Open No. 05-052107, however, the oil pump is spaced apart and below the oil pan, and hence the length of a supply path from an oil discharge port of the oil pump to an engine located on the upper side is disadvantageously increased. Thus, a time from when the oil pump is driven until when oil is supplied to the engine (hydraulic pressure rise time) is disadvantageously increased.

SUMMARY OF THE INVENTION

Preferred embodiments of the present invention solve the above problems, and provide an outboard motor and an oil pan unit for an outboard motor each simplifying the structure of a path of oil and reducing a time from when an oil pump is driven until when oil is supplied to an engine (hydraulic pressure rise time).

An outboard motor according to a first preferred embodiment of the present invention includes an engine including a plurality of cylinders and a crankshaft, a drive shaft coupled to the crankshaft and configured to transmit a rotational power of the crankshaft, an oil pan portion provided below the engine and including an oil storage region, an oil pump configured to be driven by a drive portion of the drive shaft passing through the oil storage region and located in the oil storage region, and a supply path configured to supply oil from the oil pump to the engine.

In the outboard motor according to the first preferred embodiment of the present invention, the oil pump driven by the drive portion of the drive shaft passing through the oil storage region is provided in the oil storage region such that the length of the supply path from a discharge port of the oil pump to the engine is significantly reduced, as compared with the case where the oil pump is spaced apart and below the oil pan portion. Thus, a time from when the oil pump is driven until when oil is supplied to the engine (hydraulic pressure rise time) is significantly reduced. Furthermore, the oil pump is provided in the oil storage region of the oil pan portion such that no oil path from the oil pan portion to the oil pump is necessary, and hence the structure is simplified, and the number of components is reduced. Unlike the case where the oil pump is provided above the oil pan portion, it is not necessary for oil to remain in the oil path to prime the oil pump to suck up oil from the oil pan portion when the oil pump is started, and hence the structure of the path of oil is simplified. Consequently, the time from when the oil pump is driven until when oil is supplied to the engine (hydraulic pressure rise time) is significantly reduced while the structure of the path of oil is simplified.

In the outboard motor according to the first preferred embodiment of the present invention, at least a portion of a shaft portion of the drive shaft other than the drive portion is preferably exposed to the oil storage region. According to this structure, deterioration of the drive shaft is significantly reduced or prevented, unlike the case where the shaft portion of the drive shaft is arranged in an atmosphere containing water.

In the outboard motor according to the first preferred embodiment of the present invention, the drive shaft preferably includes a first drive shaft passing through the oil storage region and a second drive shaft coupled to a lower end of the first drive shaft. According to this structure, even when the length of the drive shaft is large, the drive shaft is divided into two, and hence the first drive shaft and the second drive shaft are easily handled. When the drive shaft is divided into the first drive shaft and the second drive shaft, the first drive shaft passing through the oil storage region remains in the oil storage region, and hence leakage of oil from the oil storage region is prevented even when the second drive shaft is detached.

In this case, a first structure including the first drive shaft and the oil pan portion is preferably separable from a second structure including the second drive shaft and a lower case housing the second drive shaft. According to this structural configuration, the second structure including the second drive shaft and the lower case is easily separated from the first structure including the first drive shaft and the oil pan portion, and hence an assembly operation and a maintenance operation on the lower case and the oil pan portion is easily performed.

In the outboard motor according to the first preferred embodiment of the present invention, the oil pan portion is preferably divided into an upper portion and a lower portion, the upper portion is preferably mounted below the engine, and the lower portion is preferably mounted below the upper portion. According to this structure, the volume of the oil pan portion is easily increased by the upper portion mounted below the engine and the lower portion mounted below the upper portion.

In this case, the upper portion preferably supports a mounting connection portion configured to mount the outboard motor on a boat body. According to this structure, a member holding the mounting connection portion is used as an upper portion of the oil pan portion, and hence the capacity of the oil storage region is easily increased.

In the structure in which the oil pan portion is divided into the upper portion and the lower portion, the upper portion preferably includes an engine holder supporting the engine from below. According to this structure, the engine holder is used as a portion of the oil pan portion, and hence the capacity of the oil storage region is easily increased.

In the outboard motor according to the first preferred embodiment of the present invention, the drive portion of the drive shaft and the oil pump each preferably include a gear, and the gear of the drive shaft and the gear of the oil pump each are preferably exposed to the oil storage region. According to this structure, the gears are lubricated by oil, and hence no gear oil is supplied separately.

In the outboard motor according to the first preferred embodiment of the present invention, a filter is preferably provided in the vicinity of a suction port of the oil pump. According to this structure, extraneous material is prevented from being suctioned into the oil pump.

In the outboard motor according to the first preferred embodiment of the present invention, a portion of the supply path is preferably integral and unitary with the oil pan portion. According to this structure, no oil supply path is provided separately in a region where the oil pan portion is arranged, and hence the structure is simplified, and the number of components is reduced.

In the outboard motor according to the first preferred embodiment of the present invention, the engine preferably includes three or more cylinders, for example. According to this structure, in a large outboard motor including a large engine including three or more cylinders, the time from when the oil pump is driven until when oil is supplied to the engine (hydraulic pressure rise time) is reduced while the structure of the path of oil is simplified.

An outboard motor according to a second preferred embodiment of the present invention includes an engine including a plurality of cylinders and a crankshaft, a drive shaft coupled to the crankshaft and configured to transmit rotational power of the crankshaft, an oil pan portion provided below the engine and including an oil storage region and configured to rotatably support the drive shaft, an oil pump configured to be driven by the drive shaft and arranged in the vicinity of a bottom surface of the oil storage region and including a suction port opened to the oil storage region, and a supply path configured to supply oil from the oil pump to the engine.

As described above, the outboard motor according to the second preferred embodiment of the present invention is provided with the oil pump including the suction port opened to the oil storage region in the vicinity of the bottom surface of the oil storage region such that the length of the supply path from a discharge port of oil of the oil pump to the engine is reduced, as compared with the case where the oil pump is spaced apart and below the oil pan portion. Thus, a time from when the oil pump is driven until when oil is supplied to the engine (hydraulic pressure rise time) is reduced. Furthermore, the oil pump is provided in the vicinity of the bottom surface of the oil storage region of the oil pan portion such that no oil path from the oil pan portion to the oil pump is necessary, and hence the structure is simplified, and the number of components is reduced. Unlike the case where the oil pump is provided above the oil pan portion, it is not necessary for oil to remain in the oil path to prime the oil pump to suck up oil from the oil pan portion when the oil pump is started, and hence the structure of the path of oil is simplified. Consequently, the time from when the oil pump is driven until when oil is supplied to the engine (hydraulic pressure rise time) is reduced while the structure of the path of oil is simplified. In addition, the drive shaft is stably supported by the oil pan portion, and hence vibration of the drive shaft is significantly reduced or prevented. Moreover, the drive shaft is rotatably supported by the oil pan portion such that the drive shaft, which is a drive source of the oil pump, is arranged in the vicinity of the oil pan portion, and hence the layout of the oil pump and its drive source is compact.

In the outboard motor according to the second preferred embodiment of the present invention, the oil pan portion preferably supports the drive shaft at at least two points separated in a vertical direction. According to this structure, the drive shaft extending in the vertical direction is stably supported by the two points of the oil pan portion separated in the vertical direction.

In the outboard motor according to the second preferred embodiment of the present invention, the oil pan portion is preferably divided into an upper portion and a lower portion, the upper portion is preferably mounted below the engine, and the lower portion is preferably mounted below the upper portion and configured to rotatably support the drive shaft. According to this structure, the volume of the oil pan portion is easily increased by the upper portion mounted below the engine and the lower portion mounted below the upper portion. Furthermore, the drive shaft is stably supported by a lower portion of the oil pan portion, and hence vibration of the drive shaft is significantly reduced or prevented.

In the outboard motor according to the second preferred embodiment of the present invention, the drive shaft is preferably arranged in a drive shaft arrangement path integral and unitary with the oil pan portion. According to this structure, the drive shaft is easily supported by the drive shaft arrangement path integral and unitary with the oil pan portion.

In the outboard motor according to the second preferred embodiment of the present invention, the drive shaft is preferably divided into a first drive shaft passing through the oil storage region and a second drive shaft coupled to a lower end of the first drive shaft, and a first structure including the first drive shaft and the oil pan portion is preferably separable from a second structure including the second drive shaft and a lower case housing the second drive shaft. According to this structure, even when the length of the drive shaft is large, the drive shaft is divided into two, and hence the first drive shaft and the second drive shaft into which the drive shaft is divided are easily handled. When the drive shaft is divided into the first drive shaft and the second drive shaft, the first drive shaft passing through the oil storage region remains in the oil storage region, and hence leakage of oil from the oil storage region is prevented even when the second drive shaft is detached. Furthermore, the second structure including the second drive shaft and the lower case is easily separated from the first structure including the first drive shaft and the oil pan portion, and hence an assembly operation and a maintenance operation on the lower case and the oil pan portion is easily performed.

In the outboard motor according to the second preferred embodiment of the present invention, a filter is preferably provided in the vicinity of a suction port of the oil pump. According to this structure, extraneous material is prevented from being suctioned into the oil pump.

In the outboard motor according to the second preferred embodiment of the present invention, a portion of the supply path is preferably integral and unitary with the oil pan portion. According to this structure, no oil supply path is provided separately in a region where the oil pan portion is arranged, and hence the structure is simplified, and the number of components is reduced.

In the outboard motor according to the second preferred embodiment of the present invention, the engine preferably includes three or more cylinders, for example. According to this structure, in a large outboard motor including a large engine including three or more cylinders, the time from when the oil pump is driven until when oil is supplied to the engine (hydraulic pressure rise time) is reduced while the structure of the path of oil is simplified.

An oil pan unit for an outboard motor according to a third preferred embodiment of the present invention includes an oil pan portion including an oil storage region; a shaft supporting portion integral and unitary with the oil pan portion; a shaft including a coupling end portion configured to transmit power to an upper end and a lower end, rotatably supported by the shaft supporting portion, and to transmit a rotational drive of an engine; an oil pump configured to be driven by the shaft; and an oil path through which oil discharged from the oil pump passes.

As described above, the oil pan unit for an outboard motor according to the third preferred embodiment of the present invention is provided with the oil pump driven by the shaft rotatably supported by the shaft supporting portion integral and unitary with the oil pan portion such that the oil pump is located close to the oil pan portion. Thus, the length of the supply path from a discharge port of oil of the oil pump to the engine is reduced, as compared with the case where the oil pump is spaced apart and below the oil pan portion. Consequently, a time from when the oil pump is driven until when oil is supplied to the engine (hydraulic pressure rise time) is reduced. Furthermore, the oil pump is located close to the oil pan portion, and hence no oil path from the oil pan portion to the oil pump is necessary. Thus, the structure is simplified. Consequently, the time from when the oil pump is driven until when oil is supplied to the engine (hydraulic pressure rise time) is reduced while the structure of a path of oil is simplified. In addition, the shaft supporting portion integral and unitary with the oil pan portion and the shaft including the coupling end portion configured to transmit power to the upper end and the lower end are provided such that the oil pan unit for an outboard motor is easily divided from another unit arranged vertically thereto. Thus, operations are easily performed on the oil pan unit for an outboard motor and another unit vertically arranged thereto. The oil pan portion, the oil pump, and the drive source (shaft) of the oil pump are preferably provided as a unit.

In the oil pan unit for an outboard motor according to the third preferred embodiment of the present invention, the shaft is preferably exposed to the oil storage region. According to this structure, deterioration of the shaft is significantly reduced or prevented, unlike the case where a shaft portion thereof is arranged in an atmosphere including water.

In the oil pan unit for an outboard motor according to the third preferred embodiment of the present invention, the oil pump is preferably exposed to the oil storage region. According to this structure, oil is directly supplied from the oil storage region to the oil pump, and hence no oil path from the oil pan portion to the oil pump is necessary. Thus, the structure is simplified and the number of components is reduced.

In the oil pan unit for an outboard motor according to the third preferred embodiment of the present invention, the oil path is preferably integral and unitary with the oil pan portion. According to this structure, no supply path of oil is provided separately such that the structure is simplified, and the number of components is reduced.

According to the preferred embodiments of the present invention, as described above, the time from when the oil pump is driven until when oil is supplied to the engine (hydraulic pressure rise time) is reduced while the structure of the path of oil is simplified.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of an outboard motor 100 according to a first preferred embodiment of the present invention is now described with reference to FIGS. 1 to 6. In the figures, arrow FWD represents the forward movement direction of a boat, and arrow BWD represents the reverse movement direction of the boat. In the figures, arrow R represents the starboard side of the boat, and arrow L represents the portside of the boat.

Figure 1:
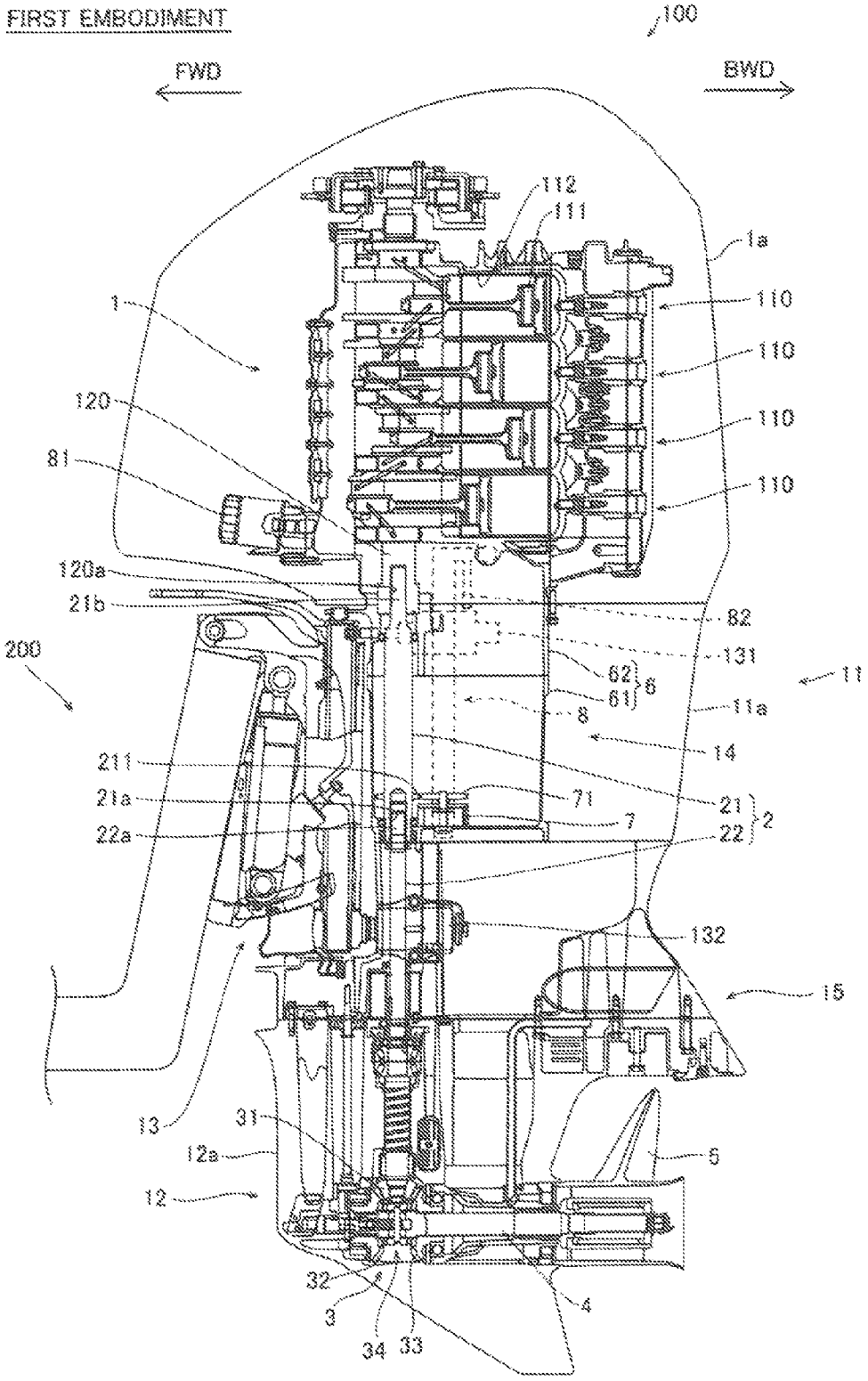
FIG. 1 is a sectional side elevational view showing the overall structure of an outboard motor according to a first preferred embodiment of the present invention.
Figure 2:
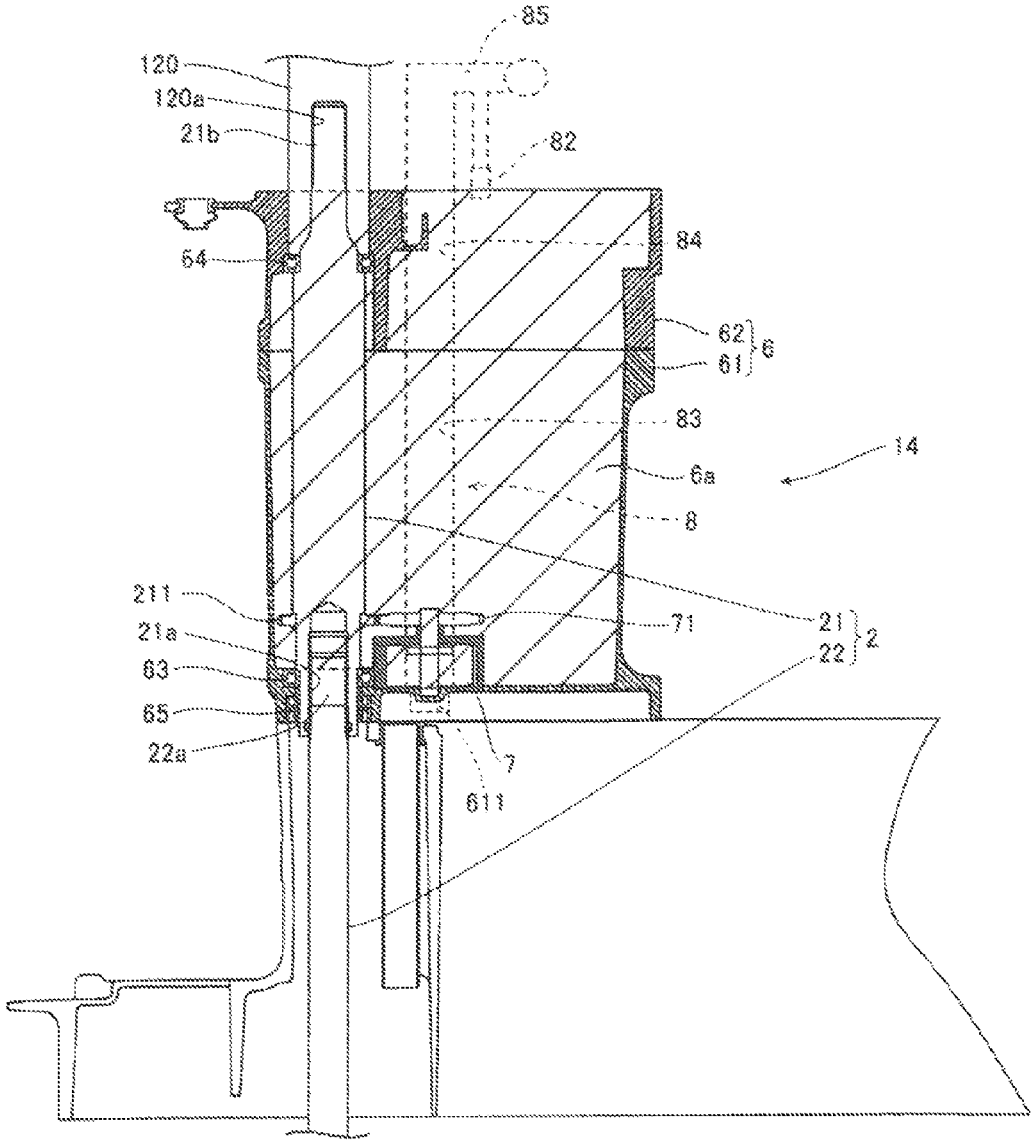
FIG. 2 is a sectional side elevational view showing the vicinity of an oil pan portion of the outboard motor according to the first preferred embodiment of the present invention.
Figure 3:
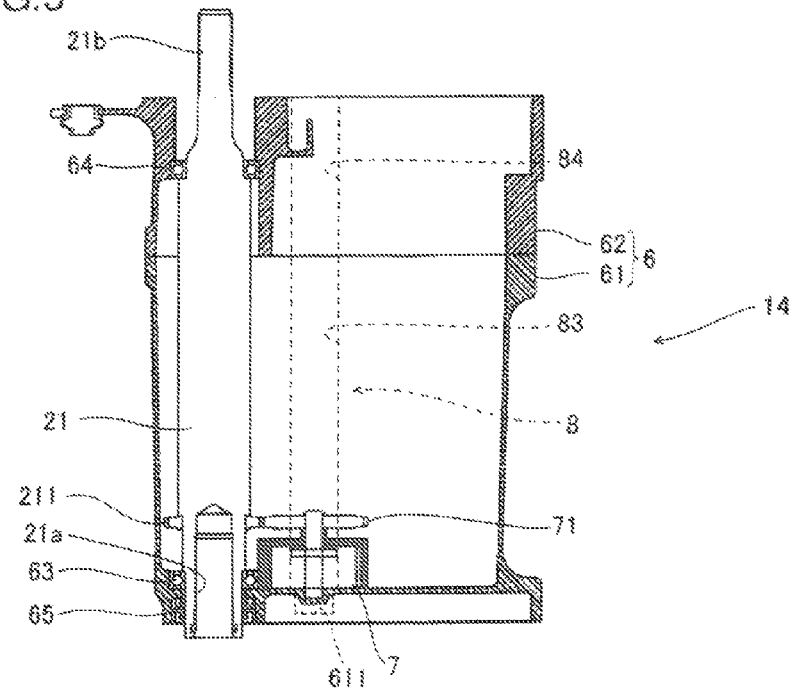
FIG. 3 is a sectional side elevational view showing an oil pan unit for an outboard motor of the outboard motor according to the first preferred embodiment of the present invention.
Figure 5:
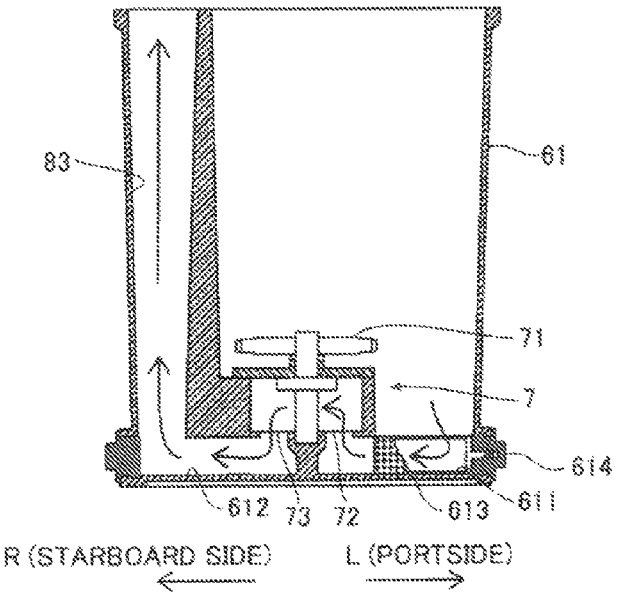
FIG. 5 is a sectional view taken along the line V-V in FIG. 4.

The outboard motor 100 is mounted on a rear portion of a boat body 200, as shown in FIG. 1. The outboard motor 100 includes an engine 1, a drive shaft 2, a gear portion 3, a propeller shaft 4, a propeller 5, an oil pan portion 6, an oil pump 7, and an oil supply path 8. The outboard motor 100 also includes an upper portion 11 located below the engine 1, a lower portion 12 located below the upper portion 11, and a bracket portion 13 arranged on the front side of the upper portion 11. The upper portion 11 includes an upper case 11*a*. The lower portion 12 includes a lower case 12*a*. The oil supply path 8 is an example of the "supply path" according to a preferred embodiment of the present invention. In FIGS. 2, 3, and 5, only the oil pan portion 6 is shown in hatched lines.

The engine 1 is provided on the upper side of the outboard motor 100 and is preferably an internal-combustion engine driven by explosive combustion of gasoline, light oil, or the like. The engine 1 is covered by an engine cover 1*a*. The engine 1 includes eight cylinders 110, for example, and a crankshaft 120. The eight cylinders 110 are arranged on the rear side of the engine 1. The eight cylinders 110 are arranged in a V-configuration in two rows, four on each of the right and left sides. The cylinders 110 each include a piston 111 and a cylinder 112. The piston 111 is connected to the crankshaft 120. The piston 111 reciprocates in a horizontal direction in the cylinder 112. The crankshaft 120 converts the reciprocal motion of the piston 111 into rotational motion. The crankshaft 120 rotates using the vertical direction or substantially vertical direction as a rotation axis.

The drive shaft 2 is coupled to the crankshaft 120 and is configured to transmit power. The drive shaft 2 extends in the vertical direction or substantially vertical direction. The drive shaft 2 is arranged such that the upper side thereof passes through the upper portion 11 (upper case 11*a*) and the lower side thereof is located in the lower portion 12 (lower case 12*a*). The drive shaft 2 includes a first drive shaft 21 passing through the oil pan portion 6 and a second drive shaft 22 coupled to a lower end of the first drive shaft 21. The first drive shaft 21 is an example of the "shaft" according to a preferred embodiment of the present invention.

According to the first preferred embodiment, the first drive shaft 21 and the second drive shaft 22 are divided. Specifically, the first drive shaft 21 is provided with a coupling end portion 21*a* on the lower end and a coupling end portion 21*b* on an upper end, as shown in FIG. 2. The second drive shaft 22 is provided with a coupling end portion 22*a* on an upper end. The coupling end portion 21*a* preferably has a concave shape opened downward, and the coupling end portions 21*b* and 22*a* preferably have a convex shape. The convex coupling end portion 22*a* is fitted into the concave coupling end portion 21*a* so that the first drive shaft 21 and the second drive shaft 22 are splined to each other. Thus, the first drive shaft 21 and the second drive shaft 22 are coupled to each other to transmit power. The first drive shaft 21 and the second drive shaft 22 are divided from each other by releasing the coupling between the coupling end portions 21*a* and 22*a*. The coupling end portion 21*b* on the upper end of the first drive shaft 21 is fitted into the concave coupling end portion 120*a* opened downward of the crankshaft 120, so that the first drive shaft 21 and the crankshaft 120 are splined to each other. Thus, the crankshaft 120 and the first drive shaft 21 are coupled to each other to transmit power.

A lower portion of the first drive shaft 21 is provided with a gear 211. The gear 211 engages with a gear 71 of the oil pump 7. In other words, the oil pump 7 is driven by rotation of the drive shaft 2. The gear 211 is an example of the "drive portion" according to a preferred embodiment of the present invention.

As shown in FIG. 1, the gear portion 3 is arranged in the lower portion 12 (lower case 12*a*). The gear portion 3 decelerates rotation of the drive shaft 2 and transmits the decelerated rotation to the propeller shaft 4. In other words, the gear portion 3 transmits the driving force of the drive shaft 2 rotating about a rotation axis extending in the vertical direction or substantially vertical direction to the propeller shaft 4 rotating about a rotation axis extending in a front to back direction. Specifically, the gear portion 3 includes a pinion gear 31, a forward movement bevel gear 32, a reverse movement bevel gear 33, and a dog clutch 34. The pinion gear 31 is mounted on a lower end of the drive shaft 2. The forward movement bevel gear 32 and the reverse movement bevel gear 33 are provided in the propeller shaft 4 to hold the pinion gear 31 therebetween. The pinion gear 31 meshes with the forward movement bevel gear 32 and the reverse movement bevel gear 33. The gear portion 3 switches between a state where the dog clutch 34 rotating integrally with the propeller shaft 4 engages with the forward movement bevel gear 32 and a state where the dog clutch 34 rotating integrally with the propeller shaft 4 engages with the reverse movement bevel gear 33 to switch the rotation direction (the forward movement direction and the reverse movement direction) of the propeller shaft 4.

The propeller 5 (screw) is connected to the propeller shaft 4. The propeller 5 is driven to rotate about the rotation axis extending in the front to back direction. The propeller 5 rotates in water to generate thrust force in an axial direction. The propeller 5 moves the boat body 200 forward or reversely according to the rotation direction.

As shown in FIG. 2, the oil pan portion 6 includes an oil storage region 6*a* (a hatched portion in the oil pan portion 6) configured to store oil to lubricate and cool various portions of the engine 1. The oil pan portion 6 is provided below the engine 1 (see FIG. 1). In other words, oil having circulated in the engine 1 falls back into the oil pan portion 6. The oil pan portion 6 includes an oil pan 61 and an engine holder 62. The engine holder 62 is mounted below the engine 1. The oil pan 61 is mounted below the engine holder 62. The oil pan 61 and the engine holder 62 are divisible. The oil pan 61 is an example of the "lower portion" according to a preferred embodiment of the present invention, and the engine holder 62 is an example of the "upper portion" according to a preferred embodiment of the present invention.

The oil pan portion 6 is provided with shaft supporting portions 63 and 64 rotatably supporting the drive shaft 2 (first drive shaft 21), as shown in FIGS. 2 and 3. The shaft supporting portions 63 and 64 each include a bearing. The shaft supporting portions 63 and 64 are spaced apart in the vertical direction. Specifically, the shaft supporting portion 63 on the lower side is provided in a lower portion of the oil pan 61. The shaft supporting portion 64 on the upper side is located in the vicinity of the center of the engine holder 62 in the vertical direction.

An oil seal 65 is arranged below the oil pan 6. The oil seal 65 is arranged below the shaft supporting portion 63. The oil seal 65 is attached to the outer peripheral surface of the first drive shaft 21 to surround the drive shaft 2 (the first drive shaft 21 and the second drive shaft 22) in the vicinity of a coupling portion between the first drive shaft 21 and the second drive shaft 22.

Figure 4:
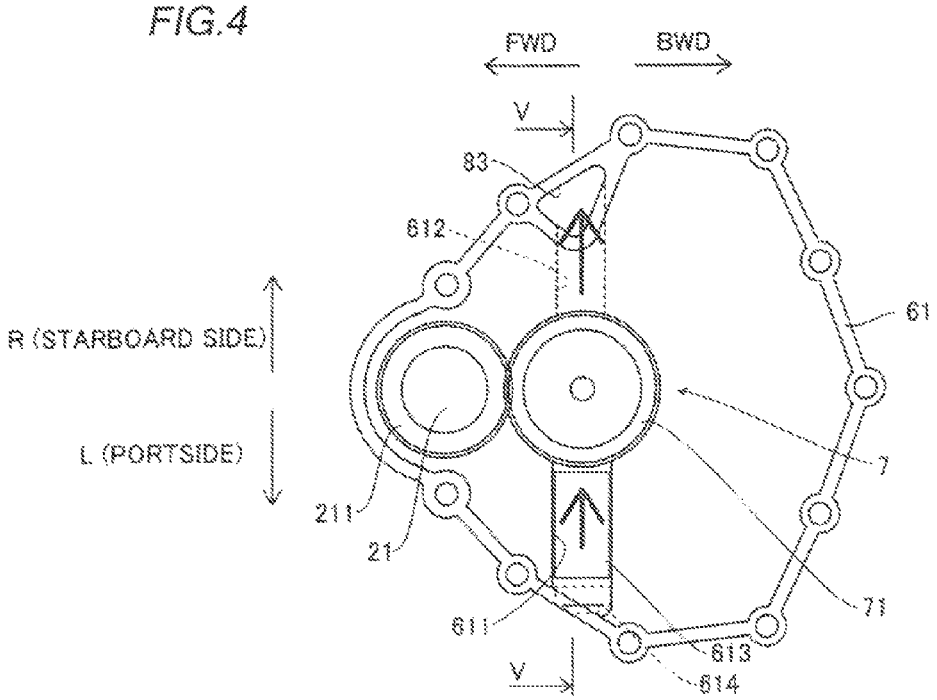
FIG. 4 is a top plan view of an oil pan of the outboard motor according to the first preferred embodiment of the present invention.

The oil pan 61 preferably has the shape of a container. As shown in FIGS. 4 and 5, an oil suction path 611 and an oil discharge path 612 are provided on the bottom surface of the oil pan 61. A filter 613 is arranged in the oil suction path 611. The left side of the oil suction path 611 is sealed by a plug 614. The plug 614 is removed to extract oil from the oil pan 61. The plug 614 of the oil pan 61 is removed so as to detach the filter 613.

As shown in FIG. 1, the engine holder 62 supports the engine 1 from below. The engine holder 62 preferably has the shape of a frame and is mounted through a gasket above the oil pan 61. The engine holder 62 holds mounting connection portions 131 configured to mount the outboard motor 100 on the boat body 200.

According to the first preferred embodiment, the drive shaft 2 (first drive shaft 21) is arranged to pass through the oil storage region 6*a* of the oil pan portion 6, as shown in FIG. 2. Specifically, the first drive shaft 21 is arranged to be partially exposed to the oil storage region 6*a*. In other words, in the oil storage region 6*a*, the first drive shaft 21 partially comes into direct contact with oil stored in the oil storage region 6*a*.

According to the first preferred embodiment, the oil pump 7 driven by the gear 211 of the drive shaft 2 is arranged in the oil storage region 6*a*. Specifically, the oil pump 7 is arranged in the vicinity of the bottom surface of the oil storage region 6*a*. The oil pump 7 is exposed to the oil storage region 6*a*.

The oil pump 7 pumps oil in the oil pan portion 6 to the engine 1. The oil pump 7 is preferably a trochoid pump, for example. The oil pump 7 includes the gear 71, a suction port 72, and a discharge port 73, as shown in FIG. 5. The gear 71 engages with the gear 211 of the drive shaft 2 such that the oil pump 7 is driven. The gear 71 of the oil pump 7 and the gear 211 of the drive shaft 2 are exposed to the oil storage region 6*a*. In other words, in the oil storage region 6*a*, the outer surface and the gear 71 of the oil pump 7 come into direct contact with the oil stored in the oil storage region 6*a*.

The suction port 72 and the discharge port 73 of the oil pump 7 are arranged in a lower portion of the oil pump 7. The suction port 72 is connected to the oil suction path 611 of the oil pan portion 6 (oil pan 61). In other words, the suction port 72 of the oil pump 7 is opened in the oil storage region 6*a*. The filter 613 is arranged in the oil suction path 611 in the vicinity of the suction port 72. In other words, the oil of the oil pan portion 6 passes through the filter 613 and is suctioned by the oil pump 7. The discharge port 73 is connected to the oil discharge path 612 of the oil pan portion 6 (oil pan 61).

Figure 6:
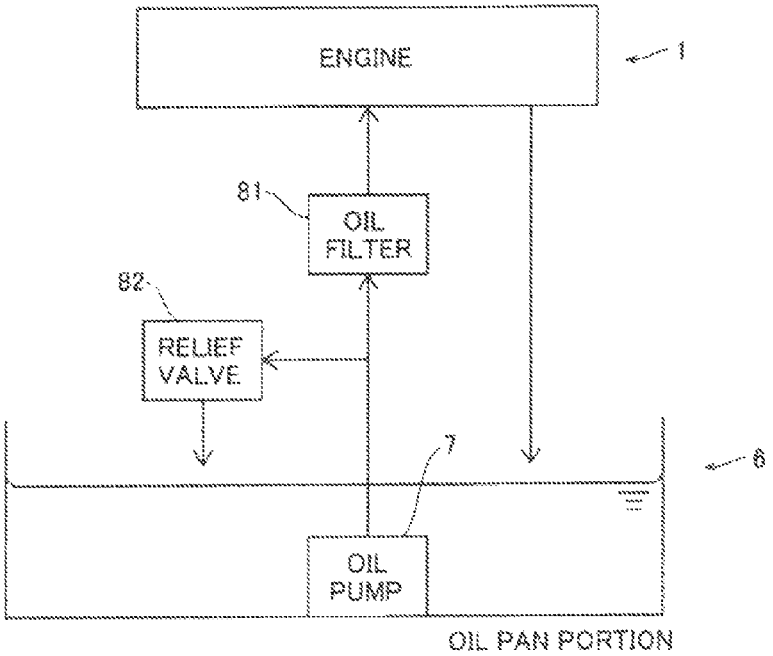
FIG. 6 is a block diagram for illustrating the circulation of oil in the outboard motor according to the first preferred embodiment of the present invention.

As shown in FIGS. 1 and 6, the oil supply path 8 is a path of oil supplied from the oil pump 7 to the engine 1. The oil supply path 8 is provided with an oil filter 81 and a relief valve 82. The oil supply path 8 is partially integral and unitary with the oil pan portion 6. Specifically, the oil supply path 8 includes a supply path 83 integral and unitary with the oil pan 61 and a supply path 84 integral and unitary with the engine holder 62, as shown in FIG. 2.

The supply path 83 of the oil pan 61 is integral and unitary with the inner surface of the oil pan 61, as shown in FIGS. 4 and 5. The supply path 83 extends in the vertical direction or substantially vertical direction. The supply path 83 preferably has a width that increases upward. The supply path 83 is connected to the oil discharge path 612. The supply path 83 is connected to the supply path 84 of the engine holder 62. The supply path 84 of the engine holder 62 is integral and unitary with the inner surface of the engine holder 62, similarly to the supply path 83. The supply path 84 extends in the vertical direction or substantially vertical direction. The supply path 84 is connected to a supply path 85 of oil provided in a body of the engine 1, as shown in FIG. 2.

According to the first preferred embodiment, an oil pan structure 14 for an outboard motor is defined by the oil pan portion 6, the first drive shaft 21, and the oil pump 7, as shown in FIG. 3. The oil pan structure 14 is separable from a lower structure 15 (see FIG. 1) including the second drive shaft 22 and the lower case 12*a* housing the second drive shaft 22. Specifically, the first drive shaft 21 and the second drive shaft 22 are divided from each other such that the oil pan structure 14 and the lower structure 15 are separated from each other. The oil pan structure 14 is an example of the "first structure" according to a preferred embodiment of the present invention. The lower structure 15 is an example of the "second structure" according to a preferred embodiment of the present invention.

The bracket portion 13 is configured to mount the outboard motor 100 on the boat body 200. Specifically, the outboard motor 100 is mounted on the boat body 200 to be rotatable about a vertical axis and a horizontal axis by the bracket portion 13, as shown in FIG. 1. The bracket portion 13 includes mounting connection portions 131 and 132. The mounting connection portions 131 and 132 are mounted on the upper portion 11 and support the engine 1, the upper portion 11, and the lower portion 12. The mounting connection portions 131 are fixed above the upper portion 11. Two mounting connection portions 131 are arranged in the horizontal direction. The mounting connection portions 132 are fixed below the upper portion 11. Two mounting connection portions 132 are arranged in the horizontal direction.

The flow of oil is now described. As shown in FIG. 6, oil is discharged by the oil pump 7 from the oil pan portion 6. The discharged oil passes through the oil filter 81 and is sent to the engine 1. The oil having been used to lubricate and cool various portions of the engine 1 falls back into the oil pan portion 6. The relief valve 82 is opened according to hydraulic pressure such that the oil discharged from the oil pump 7 is partially restored to the oil pan portion 6. Thus, the pressure of the oil supplied to the engine 1 is adjusted.

According to the first preferred embodiment, the following effects are obtained.

According to the first preferred embodiment described above, the oil pump 7 driven by the gear 211 of the drive shaft 2 passing through the oil storage region 6*a* is provided in the oil storage region 6*a* such that the length of the oil supply path 8 from the discharge port 73 of oil of the oil pump 7 to the engine 1 is reduced, as compared with the case where the oil pump 7 is spaced apart and below the oil pan portion 6. Thus, a time from when the oil pump 7 is driven until when oil is supplied to the engine 1 (hydraulic pressure rise time) is reduced. Furthermore, the oil pump 7 is provided in the oil storage region 6*a* of the oil pan portion 6 such that no oil path from the oil pan portion 6 to the oil pump 7 is necessary, and hence the structure is simplified, and the number of components is reduced. Unlike the case where the oil pump 7 is provided above the oil pan portion 6, it is not necessary for oil to remain in the oil path to prime the oil pump 7 to suck up oil from the oil pan portion 6 when the oil pump 7 is started, and hence the structure of the path of oil is simplified. Consequently, the time from when the oil pump 7 is driven until when oil is supplied to the engine 1 (hydraulic pressure rise time) is reduced while the structure of the path of oil is simplified.

According to the first preferred embodiment described above, the at least a portion of the drive shaft 2 other than the gear 211 is preferably exposed to the oil storage region 6*a*. Thus, deterioration of the drive shaft 2 is significantly reduced or prevented, unlike the case where the shaft portion of the drive shaft 2 is arranged in an atmosphere containing water.

According to the first preferred embodiment described above, the drive shaft 2 is preferably divisible into the first drive shaft 21 passing through the oil storage region 6*a* and the second drive shaft 22 coupled to the lower end of the first drive shaft 21. Thus, even when the length of the drive shaft 2 is large, the drive shaft 2 is divisible, and hence the first drive shaft 21 and the second drive shaft 22 into which the drive shaft 2 is divided are easily handled. When the drive shaft 2 is divided into the first drive shaft 21 and the second drive shaft 22, the first drive shaft 21 passing through the oil storage region 6*a* remains in the oil storage region 6*a*, and hence leakage of oil from the oil storage region 6*a* is prevented even when the second drive shaft 22 is detached.

According to the first preferred embodiment described above, the oil pan structure 14 including the first drive shaft 21 and the oil pan portion 6 are preferably separable from the lower structure 15 including the second drive shaft 22 and the lower case 12*a* housing the second drive shaft 22. Thus, the lower structure 15 including the second drive shaft 22 and the lower case 12*a* are easily separated from the oil pan structure 14 including the first drive shaft 21 and the oil pan portion 6, and hence an assembly operation and a maintenance operation on the lower case 12*a* and the oil pan portion 6 is easily performed.

According to the first preferred embodiment described above, the oil pan portion 6 is preferably divisible into the engine holder 62 and the oil pan 61. Thus, the volume of the oil pan portion 6 is easily increased by the engine holder 62 mounted below the engine 1 and the oil pan 61 mounted below the engine holder 62.

According to the first preferred embodiment described above, the engine holder 62 preferably supports the mounting connection portions 131 used to mount the outboard motor 100 on the boat body 200. Thus, a member holding the mounting connection portions 131 is used as an upper portion of the oil pan portion 6, and hence the capacity of the oil storage region 6*a* is easily increased.

According to the first preferred embodiment described above, the gear 211 of the drive shaft 2 and the gear 71 of the oil pump 7 are preferably exposed to the oil storage region 6*a*. Thus, the gears 211 and 71 are lubricated by oil, and hence it is not necessary to supply oil to the gears separately.

According to the first preferred embodiment, as described above, the filter 613 is preferably provided in the vicinity of the suction port 72 of the oil pump 7. Thus, extraneous material is prevented from being suctioned into the oil pump 7.

According to the first preferred embodiment described above, a portion of the oil supply path 8 is preferably integral and unitary with the oil pan portion 6. Thus, the oil supply path 8 is not provided separately in a region where the oil pan portion 6 is arranged, and hence the structure is simplified, and the number of components is reduced.

According to the first preferred embodiment described above, eight cylinders 110 are preferably provided in the engine 1. Thus, in a large outboard motor including a large engine including eight cylinders, the time from when the oil pump 7 is driven until when oil is supplied to the engine 1 (hydraulic pressure rise time) is reduced while the structure of the path of oil is simplified.

According to the first preferred embodiment described above, the oil pan portion 6 preferably supports the drive shaft 2 at at least two points separated in the vertical direction. Thus, the drive shaft 2 extending in the vertical direction is stably supported by the two points of the oil pan portion 6 separated in the vertical direction.

According to the first preferred embodiment described above, the oil pan 61 of the oil pan portion 6 is preferably mounted below the engine holder 62 and rotatably supports the drive shaft 2. Thus, the drive shaft 2 is stably supported by the oil pan 61 of the oil pan portion 6, and hence vibration of the drive shaft 2 is significantly reduced or prevented.

Second Preferred Embodiment

A second preferred embodiment of the present invention is now described with reference to FIG. 7. In this second preferred embodiment, an oil pump is arranged outside an oil storage region of an oil pan portion, unlike the above first preferred embodiment in which the oil pump is arranged in the oil storage region of the oil pan portion. Portions identical to those in the first preferred embodiment are denoted by the same reference numerals.

Figure 7:
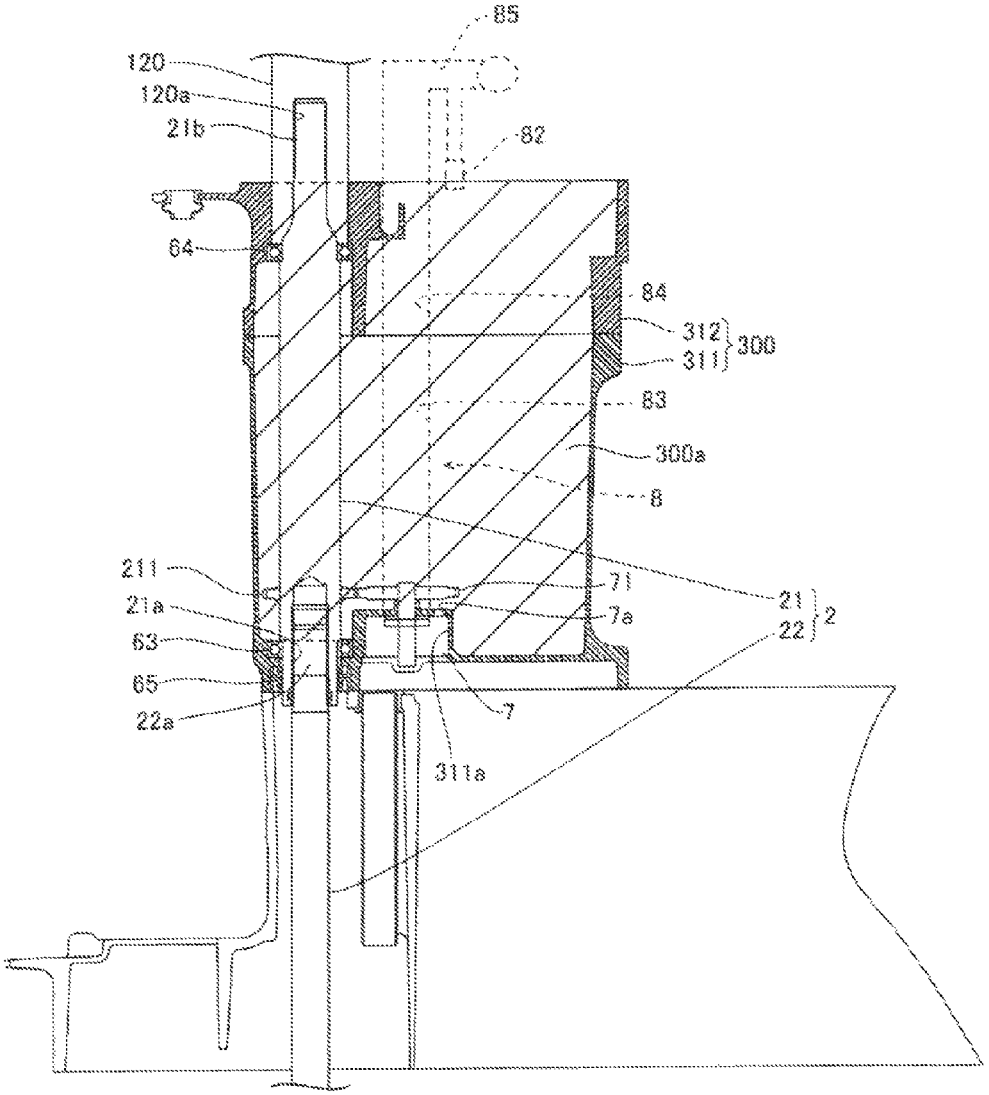
FIG. 7 is a sectional side elevational view showing the vicinity of an oil pan portion of an outboard motor according to a second preferred embodiment of the present invention.

According to the second preferred embodiment, an oil pan portion 300 includes an oil storage region 300*a* (a hatched portion in the oil pan portion 300) configured to store oil, as shown in FIG. 7. The oil pan portion 300 is provided below an engine 1 (see FIG. 1). In other words, oil having circulated in the engine 1 falls back into the oil pan portion 300. The oil pan portion 300 includes an oil pan 311 and an engine holder 312. The engine holder 312 is mounted below the engine 1. The oil pan 311 is mounted below the engine holder 312. The oil pan 311 and the engine holder 312 are divisible. The oil pan 311 is an example of the "lower portion" according to a preferred embodiment of the present invention, and the engine holder 312 is an example of the "upper portion" according to a preferred embodiment of the present invention. In FIG. 7, only the oil pan portion 300 is shown in hatched lines.

According to the second preferred embodiment, a drive shaft 2 (first drive shaft 21) is arranged to pass through the oil storage region 300*a* of the oil pan portion 300, similarly to the above first preferred embodiment. Specifically, a shaft portion of the first drive shaft 21 is exposed to the oil storage region 300*a*. In other words, in the oil storage region 300*a*, the shaft portion of the first drive shaft 21 comes into direct contact with oil stored in the oil storage region 300*a*.

An oil pump 7 driven by a gear 211 of the drive shaft 2 is arranged in the vicinity of the bottom surface of the oil storage region 300*a*. According to the second preferred embodiment, the oil pump 7 is arranged outside the oil storage region 300*a* of a lower portion of the oil pan 311, unlike the first preferred embodiment. In other words, a concave pump storage portion 311*a* recessed upward is provided on the lower surface of a bottom portion of the oil pan 311, and the oil pump 7 is arranged in the concave pump storage portion 311*a*. The oil pump 7 includes a suction port 7*a* opened to the oil storage region 300*a*. In other words, the oil pump 7 directly suctions oil from the oil pan portion 300 (oil pan 311) without requiring a path of oil. The oil pump 7 is provided with a gear 71. The gear 71 engages with the gear 211 of the drive shaft 2. The gear 71 is exposed to the oil storage region 300*a*. In other words, in the oil storage region 300*a*, the gear 71 of the oil pump 7 comes into direct contact with the oil stored in the oil storage region 300*a*.

The remaining structure of the second preferred embodiment is similar to that of the above first preferred embodiment.

According to the second preferred embodiment, the following effects are obtained.

According to the second preferred embodiment described above, the oil pump 7 including the suction port 7*a* opened to the oil storage region 300*a* is preferably provided in the vicinity of (outside) the bottom surface of the oil storage region 300*a* such that the length of an oil supply path 8 from an oil discharge port of the oil pump 7 to the engine 1 is reduced as compared with the case where the oil pump 7 is spaced apart and below the oil pan portion 300. Thus, a time from when the oil pump 7 is driven until when oil is supplied to the engine 1 (hydraulic pressure rise time) is reduced. Furthermore, the oil pump 7 is provided in the vicinity of the bottom surface of the oil storage region 300*a* of the oil pan portion 300 such that no oil path from the oil pan portion 300 to the oil pump 7 is necessary, and hence the structure is simplified, and the number of components is reduced. The oil pan portion 300 stably supports the drive shaft 2, and hence vibration of the drive shaft 2 is significantly reduced or prevented. The oil pan portion 300 rotatably supports the drive shaft 2 such that the drive shaft 2, which is a drive source of the oil pump 7, is arranged in the vicinity of the oil pan portion 300, and hence the layout of the oil pump 7 and its drive source is compact.

The remaining effects of the second preferred embodiment are similar to those of the above first preferred embodiment.

Third Preferred Embodiment

A third preferred embodiment of the present invention is now described with reference to FIG. 8. In this third preferred embodiment, a shaft portion of a first drive shaft is mostly arranged outside an oil storage region of an oil pan portion, unlike the above first preferred embodiment in which the shaft portion of the first drive shaft is mostly arranged in the oil storage region of the oil pan portion. Portions identical to those in the first preferred embodiment are denoted by the same reference numerals.

Figure 8:
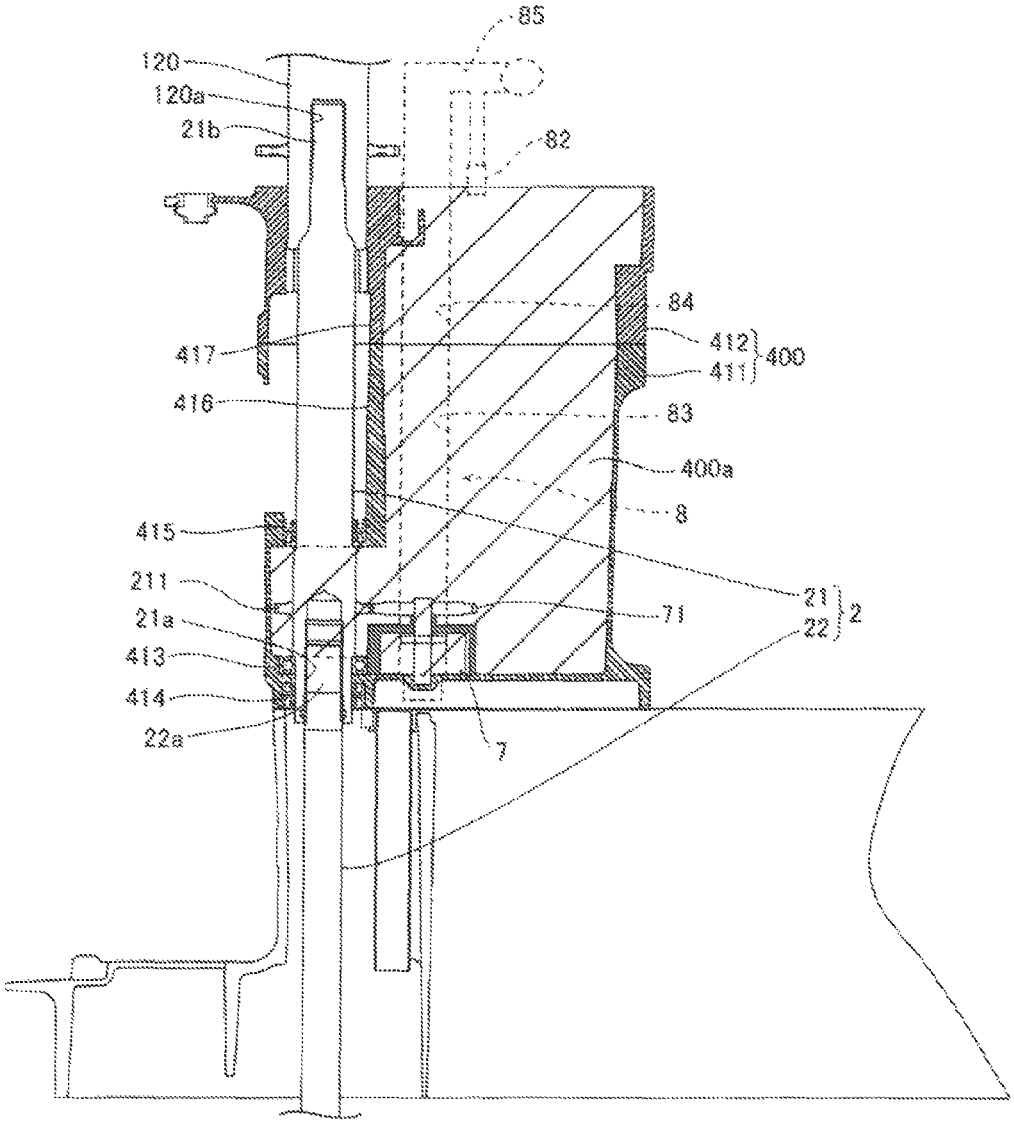
FIG. 8 is a sectional side elevational view showing the vicinity of an oil pan portion of an outboard motor according to a third preferred embodiment of the present invention.

According to the third preferred embodiment, an oil pan portion 400 includes an oil storage region 400*a* (a hatched portion in the oil pan portion 400) configured to store oil, as shown in FIG. 8. The oil pan portion 400 is provided below an engine 1 (see FIG. 1). In other words, oil having circulated in the engine 1 falls back into the oil pan portion 400. The oil pan portion 400 includes an oil pan 411 and an engine holder 412. The engine holder 412 is mounted below the engine 1. The oil pan 411 is mounted below the engine holder 412. The oil pan 411 and the engine holder 412 are divisible. The oil pan 411 is an example of the "lower portion" according to a preferred embodiment of the present invention, and the engine holder 412 is an example of the "upper portion" according to a preferred embodiment of the present invention. In FIG. 8, only the oil pan portion 400 is shown in hatched lines.

The oil pan portion 400 is provided with a shaft supporting portion 413 rotatably supporting the drive shaft 2 (first drive shaft 21). The shaft supporting portion 413 includes a bearing. The shaft supporting portion 413 is provided in a lower portion of the oil pan 411.

In the oil pan portion 400, oil seals 414 and 415 are provided. The oil seal 414 is arranged below the shaft supporting portion 413. The oil seal 414 is attached to the outer peripheral surface of a first drive shaft 21 to surround a drive shaft 2 (the first drive shaft 21 and a second drive shaft 22) in the vicinity of a coupling portion between the first drive shaft 21 and the second drive shaft 22. The oil seal 415 is located above the coupling portion between the first drive shaft 21 and the second drive shaft 22. The oil seal 415 is attached to the outer peripheral surface of the first drive shaft 21.

Also according to the third preferred embodiment, the drive shaft 2 (first drive shaft 21) passes through the oil storage region 400*a* of the oil pan portion 400, similarly to the above first and second preferred embodiments. Specifically, the first drive shaft 21 in a region between the oil seals 414 and 415 is exposed to the oil storage region 400*a*. A gear 211 provided in the region between the oil seals 414 and 415 is also exposed to the oil storage region 400*a*. In other words, in the oil storage region 400*a*, a portion of the first drive shaft 21 in the region between the oil seals 414 and 415 and the gear 211 come into direct contact with oil stored in the oil storage region 400*a*.

According to the third preferred embodiment, on the other hand, the first drive shaft 21 located above the oil seal 415 is located outside the oil storage region 400*a*, unlike the above first and second preferred embodiments. In other words, at least an upper half of the entire first drive shaft 21 is located outside the oil storage region 400*a*.

According to the third preferred embodiment, the drive shaft 2 (first drive shaft 21) is arranged in drive shaft arrangement paths 416 and 417 integral and unitary with the oil pan portion 400. The drive shaft arrangement path 416 is integral and unitary with the oil pan 411. The drive shaft arrangement path 417 is integral and unitary with the engine holder 412. The first drive shaft 21 passes through the drive shaft arrangement path 416 of the oil pan 411 and the drive shaft arrangement path 417 of the engine holder 412.

The remaining structure of the third preferred embodiment is similar to that of the above first preferred embodiment.

According to the third preferred embodiment, the following effects are obtained.

According to the third preferred embodiment, the oil pump 7 driven by the gear 211 of the drive shaft 2 passing through the oil storage region 400*a* is preferably provided in the oil storage region 400*a*, similarly to the above first preferred embodiment such that the structure of a path of oil is simplified, and a time from when the oil pump 7 is driven until when oil is supplied to the engine 1 (hydraulic pressure rise time) is reduced.

According to the third preferred embodiment described above, the drive shaft 2 is preferably arranged in the drive shaft arrangement paths 416 and 417 that are integral and unitary with the oil pan portion 400. Thus, the drive shaft 2 is easily supported by the drive shaft arrangement paths 416 and 417 that are integral and unitary with the oil pan portion 400.

The remaining effects of the third preferred embodiment are similar to those of the above first preferred embodiment.

The preferred embodiments of the present invention disclosed above are considered as illustrative in all points and not restrictive. The range of the present invention is shown not by the above description of the preferred embodiments but by the scope of claims, and all modifications within the meaning and range equivalent to the scope of claims are further included.

For example, while eight cylinders are preferably provided in the engine in each of the above first to third preferred embodiments, the present invention is not restricted to this. According to a preferred embodiment of the present invention, a plurality of cylinders other than eight cylinders (preferably at least three cylinders) may alternatively be provided in the engine.

While the drive shaft is preferably divisible into the first drive shaft and the second drive shaft in each of the above first to third preferred embodiments, the present invention is not restricted to this. According to a preferred embodiment of the present invention, the drive shaft may not be divisible or may be divisible into three or more portions.

While the oil pan portion preferably supports the drive shaft at the two points separated in the vertical direction in each of the above first and second preferred embodiments, the present invention is not restricted to this. According to a preferred embodiment of the present invention, the oil pan portion may alternatively support the drive shaft at three or more points separated in the vertical direction.

While the shaft supporting portions preferably each include the bearing in each of the above first to third preferred embodiments, the present invention is not restricted to this. According to a preferred embodiment of the present invention, the shaft supporting portions each may alternatively be an element other than a bearing.

While the oil pump is preferably a trochoid pump in each of the above first to third preferred embodiments, the present invention is not restricted to this. According to a preferred embodiment of the present invention, the oil pump may alternatively be a pump other than the trochoid pump. For example, the oil pump may be a gear pump.

While the oil pan portion is preferably divisible into the upper portion (engine holder) and the lower portion (oil pump) in each of the above first to third preferred embodiments, the present invention is not restricted to this. According to a preferred embodiment of the present invention, the oil pan portion may not be divisible but may be integral and unitary.

While the oil supply path is integral and unitary with the oil pan portion in each of the above first to third preferred embodiments, the present invention is not restricted to this. According to a preferred embodiment of the present invention, the oil supply path may not be integral and unitary with the oil pan portion. For example, a tube may alternatively be provided separately and be used as the oil supply path.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a plurality of cylinders and a crankshaft;

a drive shaft coupled to the crankshaft and configured to transmit a rotational power of the crankshaft;

an oil pan provided below the engine and including an oil storage region;

an oil pump configured to be driven by a drive portion of the drive shaft passing through the oil storage region of the oil pan, the oil pump being located in the oil storage region of the oil pan; and a supply path configured to supply oil from the oil pump to the engine.

2. The outboard motor according to claim 1, wherein at least a portion of a shaft portion of the drive shaft other than the drive portion is exposed to the oil storage region of the oil pan.

3. The outboard motor according to claim 1, wherein the drive shaft includes a first drive shaft passing through the oil storage region of the oil pan and a second drive shaft coupled to a lower end of the first drive shaft.

4. The outboard motor according to claim 3, wherein a first structure including the first drive shaft and the oil pan is configured to be separable from a second structure including the second drive shaft and a lower case housing the second drive shaft.

5. The outboard motor according to claim 1, wherein the oil pan includes an upper portion and a lower portion, the upper portion is mounted below the engine, and the lower portion is mounted below the upper portion.

6. The outboard motor according to claim 5, wherein the upper portion supports a mounting connection portion configured to mount the outboard motor on a boat body.

7. The outboard motor according to claim 5, wherein the upper portion includes an engine holder supporting the engine from below.

8. The outboard motor according to claim 1, wherein the drive portion of the drive shaft and the oil pump each include a gear, and the gear of the drive shaft and the gear of the oil pump each are exposed to the oil storage region of the oil pan.

9. The outboard motor according to claim 1, further comprising a filter located in a vicinity of a suction port of the oil pump.

10. The outboard motor according to claim 1, wherein a portion of the supply path is integral and unitary with the oil pan.

11. The outboard motor according to claim 1, wherein the engine includes three or more cylinders.

12. An outboard motor comprising:

an engine including a plurality of cylinders and a crankshaft;

a drive shaft coupled to the crankshaft and configured to transmit a rotational power of the crankshaft;

an oil pan provided below the engine and including an oil storage region and a shaft supporting portion that rotatably supports the drive shaft;

an oil pump driven by the drive shaft and located in a vicinity of a bottom surface of the oil storage region of the oil pan, the oil pump including a suction port opened to the oil storage region of the oil pan; and a supply path configured to supply oil from the oil pump to the engine.

13. The outboard motor according to claim 12, wherein the oil pan supports the drive shaft at at least two points separated in a vertical direction.

14. The outboard motor according to claim 12, wherein the oil pan includes an upper portion and a lower portion, the upper portion is mounted below the engine, and the lower portion is mounted below the upper portion and configured to rotatably support the drive shaft.

15. The outboard motor according to claim 12, wherein the drive shaft is located in a drive shaft arrangement path integral and unitary with the oil pan.

16. The outboard motor according to claim 12, wherein the drive shaft includes a first drive shaft passing through the oil storage region of the oil pan and a second drive shaft coupled to a lower end of the first drive shaft; and a first structure including the first drive shaft and the oil pan is configured to be separable from a second structure including the second drive shaft and a lower case housing the second drive shaft.

17. The outboard motor according to claim 12, further comprising a filter located in a vicinity of a suction port of the oil pump.

18. The outboard motor according to claim 12, wherein a portion of the supply path is integral and unitary with the oil pan.

19. The outboard motor according to claim 12, wherein the engine includes three or more cylinders.

20. An oil pan unit for an outboard motor, the oil pan unit comprising:

an oil pan including an oil storage region;

a drive shaft supporting portion integral and unitary with the oil pan;

a drive shaft including a coupling end portion coupled to a lower drive shaft to transmit power to the lower drive shaft, the drive shaft being rotatably supported by the drive shaft supporting portion and configured to transmit a rotational drive of an engine;

an oil pump configured to be driven by the drive shaft; and an oil path through which oil discharged from the oil pump passes.

21. The oil pan unit for an outboard motor according to claim 20, wherein the drive shaft is exposed to the oil storage region of the oil pan.

22. The oil pan unit for an outboard motor according to claim 20, wherein the oil pump is exposed to the oil storage region of the oil pan.

23. The oil pan unit for an outboard motor according to claim 20, wherein the oil path is integral and unitary with the oil pan.

* * * * *